US006996336B1

(12) United States Patent
Mahoney et al.

(10) Patent No.: US 6,996,336 B1
(45) Date of Patent: Feb. 7, 2006

(54) ECONOMICAL HEATED GREASE STORAGE TANK

(76) Inventors: John Mahoney, c/o Mahoney Environmental, Inc., 1819 Moen Ave., Joliet, IL (US) 60436; Donald Onken, c/o Mahoney Environmental, Inc., 1819 Moen Ave., Joliet, IL (US) 60436

( * ) Notice: Subject to any disclaimer, the term of this patent is extended or adjusted under 35 U.S.C. 154(b) by 0 days.

(21) Appl. No.: 10/961,174

(22) Filed: Oct. 8, 2004

(51) Int. Cl.
*F24H 1/20* (2006.01)

(52) U.S. Cl. ..... 392/455; 219/523; 222/146.5

(58) Field of Classification Search ..... 392/455, 392/456, 459; 219/523; 222/146.5
See application file for complete search history.

(56) References Cited

U.S. PATENT DOCUMENTS

| | | | | |
|---|---|---|---|---|
| 1,705,417 | A * | 3/1929 | Rogers | 392/456 |
| 4,844,927 | A * | 7/1989 | Morris et al. | 426/307 |
| 6,002,838 | A * | 12/1999 | Nir | 392/449 |
| 6,157,776 | A * | 12/2000 | Onken | 392/441 |
| 6,577,817 | B2 * | 6/2003 | Harris | 392/481 |

* cited by examiner

*Primary Examiner*—Thor S. Campbell
(74) *Attorney, Agent, or Firm*—Todd S. Parkhurst; Holland & Knight LLP

(57) ABSTRACT

A used cooking oil and grease storage tank is comprised of a plastic material such as, polyethylene. Advantageously, a metal heating element or member is secured to a top cover member of the tank and extends downward into the used cooking all and grease stored with in the plastic tank member. Input and drain connections are also preferably made through the top cover member.

11 Claims, 1 Drawing Sheet

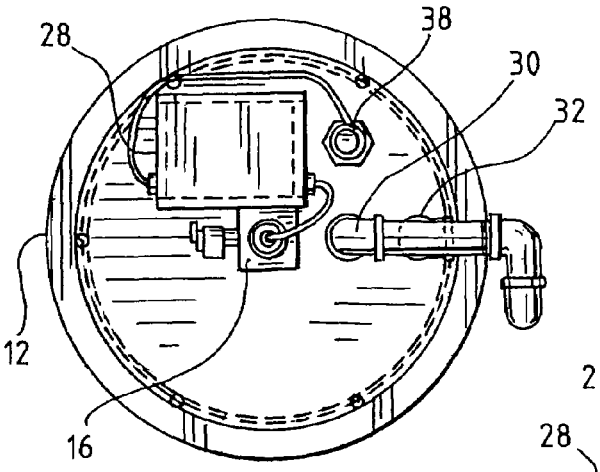
FIG. 2
FIG. 1
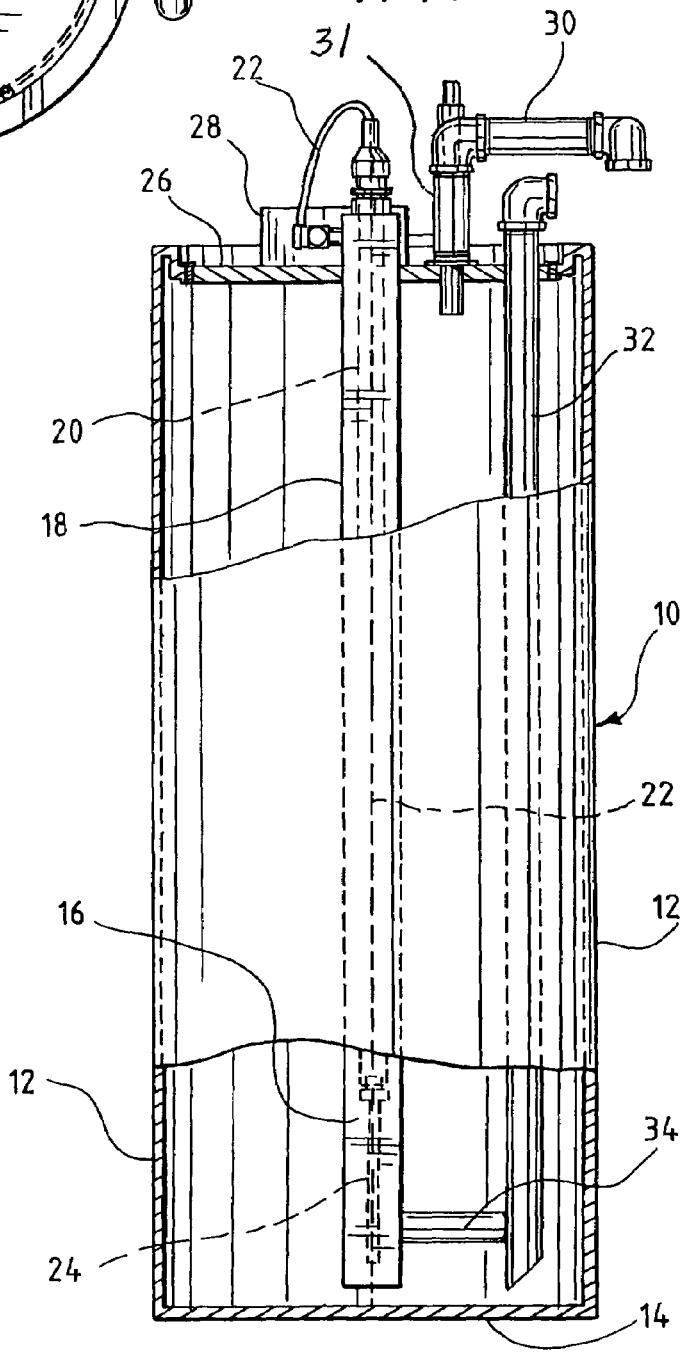

ECONOMICAL HEATED GREASE STORAGE TANK

BACKGROUND OF THE INVENTION

1. Field of the Invention

The present invention is generally directed to the field of cooking grease storage devices. More specifically, the present invention is directed to a heated grease storage tank that is substantially comprised of an plastic material such as, for example, polyethylene. Preferably the plastic material is transparent or at least semi-transparent.

2. Description of the Related Art

It is well-known that the use of cooking oil for frying food in the food service industry has required that restaurants provide systems and methods for storing used cooking oils so that that the oil and grease may be subsequently recycled. Up until the mid-1980's standard recycling equipment was the 55 gallon barrel. This equipment was improved in the 1970's by the provision of a cosmetic, metal cabinet enclosure to encase the barrels.

In 1983 Don Onken of Onken Enterprises introduced the bulk tank storage method of collection to the rendering industry. This collection method tripled route capacity and reduced processing costs by bulking the material collected in the truck. During the 1990's, automated grease handling systems were developed which automated a number of the steps involved in the recycling of fats from the fryer to the recycling plant.

These alternate solutions typically placed the grease and used cooking oil in a heated storage tank usually located inside the restaurant kitchen. The grease and used cooking oil located within the storage tank were transferred to a truck by through-the-exterior-wall connections. During storage it is necessary to maintain the grease at a warm temperature so that it readily will flow through the evacuation plumbing to the collection truck. It is also necessary to have a reliable means for monitoring the remaining capacity of the storage tank to avoid over-filling it.

U.S. Pat. No. 6,157,776 describes a heating system for a used cooking oil and grease storage tank. The storage tank described in this prior art patent is typically comprised of a large metal vessel for holding the used cooking oil and grease. While this approach provides a reliable solution for temporarily storing the used cooking oils and grease, the metal storage tanks which are typically comprised of stainless steel or other metals are very expensive. In order to reduce the costs associated with the tanks and the overall recovery process, a variety of alternate solutions have been previously examined.

Previously, for more than 30 years during which used cooking oils have been recovered, stored and recycled, there has been no cooking oil storage tank solution which provides a practical and economical storage tank made from less expensive material such as plastic or polyethylene. Some of the difficulties encountered in the development of such a storage tank include satisfying the requirement that the tank contents be heated during storage in order to provide easy removal of the used cooking oil and grease. The storage tanks of the prior art typically included L-shaped heating members, which required openings in the side wall of the tank which are difficult to implement, when the tank is comprised of a plastic material such as, for example, polyethylene.

Accordingly, there remains a need in the field of cooking oil and grease storage solutions for a more economical storage tank structure. It is therefore one object and advantage of the present invention to provide a practical and economical heated used cooking oil and grease storage tank. It is another object and advantage of the present invention to provide a provide a practical and economical heated used cooking oil and grease storage tank wherein heat is transmitted through the tank so as to maintain all of the grease in a fluid state. Other objects and advantages of the present invention will be apparent in light of the following Summary and Detailed Description of the Presently Preferred Embodiments.

SUMMARY OF THE INVENTION

In accordance with one aspect of the presently preferred exemplary embodiments of the present invention, the used cooking oil and grease storage tank is comprised of a plastic material such as, polyethylene. Advantageously, a metal heating element or member is secured to a top cover member of the tank and extends downward into the used cooking all and grease stored with in the plastic tank member.

In accordance with the preferred exemplary embodiments, the heating element preferably provides controlled heat (approximately 110.degree.–120.degree.) throughout the tank. The submersible heat element portion is capable of achieving this goal by extending at least substantially through the entire tank. The voltage of the submersible heater is sized so that it can heat an internal fluid (a glycol-water mix) held in the heating member to the optimum temperature so that the fat is held at between 110 and 120 degrees Fahrenheit.

In accordance with the preferred exemplary embodiments of the present invention, advantageously all of the fluid connections into the tank are preferably made through the top lid portion of the heated storage tank member in order to eliminate the need for any openings in the side walls or bottom of the tank. The top lid portion of the tank member may be entirely comprised of a metal material such as, for example, stainless steel.

Advantageously, the power supply and electrical controls for the submerged heating element may be located on the top lid member. By providing all of the connections to the tank through the top portion or lid, the physical footprint of actual tank can be desirable reduced because there is no need for any pipes to extend from the side walls of the tank. The used of a metal structure for the top lid portion provides a convenient and sturdy structural element for supporting the control elements and providing support for any pipes and required plumbing connections.

The present invention will be better understood and further objects and advantages thereof will become more apparent based on the following detailed description of preferred embodiments when considered in light of the drawings.

BRIEF DESCRIPTION OF THE DRAWINGS

FIG. 1 is a perspective view of the tank member in accordance with the present invention which illustrates the side walls and internal structures of the tank;

FIG. 2 is a top plan view of the tank member illustrated in FIG. 1.

DESCRIPTION OF THE PRESENTLY PREFERRED EMBODIMENTS

FIG. 1 illustrates a first preferred exemplary embodiment of the present invention which is shown generally at 10. In accordance with the present invention, the used cooking oil and grease storage tank is preferably comprised on a tank member having side walls 12 which are preferably comprised of a plastic material such as, for example, polyethylene. The use of a plastic material such as polyethylene is preferred so that the tank member can be economically produced in significant quantities. The physical structure of the tank member having the side walls 12 is preferably cylindrical. However, those skilled in the art will appreciate that alternate shapes and sizes of the actual tank may be varied depending upon design choices and the present invention is not limited to a cylindrical structure.

The base portion of the tank member, 14 is also preferably comprised of a plastic material such as, for example, polyethylene. It is preferred that both the base member 14 and the side walls 12 be comprised of the same plastic material. The storage tank comprised of the side walls 12 and base portion 14 contains the used cooking oil and grease from a restaurant. The tank member is preferably physically located within the restaurant.

FIG. 1 illustrates a centrally located heating element 16 which is comprised of an outer heater element containment structure 18. The outer heater element containment structure 18 is preferably comprised of the metal such as, for example, steel and is preferably centrally located and may be desirably comprised of a readily available cylindrical pipe member. The heater element containment structure 18 preferably includes a liquid bath contained with in the containment structure 18. The liquid bath is preferably a liquid such as antifreeze that is isolated from the stored used cooking oil and grease. An internal conduit member 20 is preferably provided for locating electrical wires 22 which are connected to the actual heating element 24. The actual electric heating element 24 is preferably screwed into the conduit member 20 via mutual threads such that the heating element may be easily accessed when the conduit 20 is removed from the antifreeze bath. The threaded engagement also prevents the liquid antifreeze from contacting the wiring 22 and/or the electrical connections for the heater element 24. The entire heating element 16 is preferably centrally located within the tank member in order to ensure uniform heating of the stored used cooking oil and grease. Those skilled in the art will appreciate that alternate locations are possible.

In accordance with the preferred exemplary embodiment, the top lid member 26 is preferably comprised of at least one metal plate portion so that the heating element 16 and other structures may be secured thereto. In accordance with the preferred embodiment, the top lid member 26 is may actually be comprised of a laminated structure comprising top and bottom metal plate portions and a centrally located plastic body. However it is preferred that a solid steel plate be used for the lid in order to ensure the structural integrity. Those in the art will appreciate that this laminated physical structure is not necessary. The laminated structure is preferred in order to reduce the overall cost and weight of the storage tank while also ensuring that the lid member is sufficiently strong for supporting and securing there is elements such as the heater and plumbing connections.

In accordance with the presently preferred embodiment of the present invention, a top used cooking oils supply member 30 transfers used cooking oil and grease into the storage tank. The used cooking oils supply member 30 is also preferably secured to the top lid member 26. A drain pipe 32 is secured to the top lid member 26 and extends all the way to a bottom of the storage tank. Preferably, in accordance with the preferred exemplary embodiment of the present invention, the heating element 16 is secured by a structural support member 34 to the drain pipe 32. This provides additional structural integrity for the overall system and also aids in the heat transfer from the heating element 16 into the used cooking oil and grease located within the storage tank.

In accordance with the presently preferred embodiment of the present invention, a top used cooking oils supply member 30 is used for transferring used cooking oil and grease into the storage tank. The used cooking oils supply member 31 is also preferably secured to the top lid member 26. A drain pipe 32 is a secured to the top lid member 26 and extends all the way to a bottom of the storage tank. Preferably, in accordance with the preferred exemplary embodiment of the present invention, the heating element 16 is secured by structural support member 34 to the drain pipe 32. This provides additional structural integrity for the overall system and also aids in the heat transfer from the heating element 16 into the used cooking oil and grease located within the storage tank.

Advantageously, in accordance with the preferred embodiment of the present invention, the top lid member 26 is secured to each of the heating element 16, supply member 31, drain pipe 32 and the power and control box 28 providing an assembly that is easily positioned on top of the tank with portions extending into the tank. The lid member 26 preferably rests on the top side walls 12 out of the tank body.

FIG. 2 is a top plan view which illustrates the physical location of the various structures on the lid member 26. As shown in FIG. 2, heating-element-16, supply member 31, drain pipe 32 and the power and control box 28 are positioned at various locations of the top lid member 26. Those skilled in the art will appreciate that the specific arrangement illustrated in FIG. 2 is not critical and that a variety of alternate locations for the various structures may be provided. Additionally, as shown in FIG. 2, an electronic float member 38 is also preferably secured to the top lid member 26. The electronic float 38 provides a cut off signal to the power and control box 28 whenever the storage tank becomes full. Electronic floats of this type are generally known in the art and have been used in the industry for many years.

Once the tank and lid member have been located within a restaurant, various other fittings are provided in order to easily transfer used cooking oil and grease into an out from the storage tank as is known in the art. In accordance with the preferred exemplary embodiments of the present invention, a used cooking oil and grease storage tank is provided that is economically fashioned from plastic such as, for example, polyethylene. Accordingly, the storage tank can be manufactured for a significantly lower cost than the used cooking oil and grease storage tanks of the prior art. Additionally, this storage tank provides access to the plastic storage tank without requiring openings on the side wall of the tank which could decrease the physical strength of the overall tank member.

The substantially reduced weight of the resultant tank product dramatically reduces the shipping costs for the product while also providing a tank that is much easier to handle and install. Furthermore, the plastic tank which is preferably transparent or at least semi-transparent allows users to see the contents of the tank to readily determine when it needs to be serviced. The system preferably uses low voltage control and signaling which may also provide for remote indications. The system also preferably has a horn and light to indicate the tank level is full and an indicator light may be provided to confirm its operational status as is known in the art.

A system horn may be used to signal an alarm when the float makes contact and the alarm preferably goes off every 20 min. to remind users of the full level. In the preferred embodiment, the controller supplies 120 volts to the heater to ensure the oil does not solidify. The controller may supply voltage to a solenoid control valve in order to stop the flow of oil when the tank has reached a full level. When the Tank reaches the full level the pump may also disabled so it can no longer fill the tank.

A pressure relief valve may also be employed on the top of the tank in order to eliminate any overpressure conditions.

We claim:

1. A storage tank for storing used cooking oil and/or grease used in a cooker:

wherein the storage tank is comprised primarily of plastic, wherein the storage tank is comprised of at least one side wall and a bottom wall; and a top lid member wherein the lid member is at least partially comprised of a metal plate, an elongated heating element secured to the lid member extending into the tank, and a fill and drain pipe secured to the top lid member, the drain pipe extending toward the base of the tank, the elongated heating element being secured to the drain pipe at a lower portion thereof.

2. The storage tank of claim 1, further comprising a full tank determining means which determines when the tank is full of cooking oil or grease.

3. A storage tank as set forth in claim 1, further comprising a power and control box secured to the top lid member, the power and control box including a thermostat for controlling the elongated heating element to limit a temperature of the cooking oil and/or grease located within the storage tank.

4. A storage tank as set forth in claim 3, in which said elongated heating element heats the grease to a temperature of about 110 degree–120 degree F.

5. A storage tank as set forth in claim 1 in which said elongated heating element includes a substantially linear housing filled with a heat transfer fluid therein which is heated by an internal heating unit.

6. A system as set forth in claim 5, in which said heat transfer fluid comprises an antifreeze.

7. A storage tank for storing used cooking oil and/or grease used in a cooker, comprising:

a storage tank member primarily comprised of plastic, wherein the storage tank is comprised of at least one side wall and a bottom wall; and a top lid member wherein the lid member is at least partially comprised of a metal plate, an elongated heating element secured to the lid member extending into the tank, and a fill pipe and a drain pipe secured to the top lid member, the drain pipe extending toward the base of the tank, said elongated heating element including an elongated hollow housing, an elongated internal heating element within the housing and an antifreeze heat transfer fluid which can be heated by said heating element and which can transfer heat to the housing so as to further transfer heat to the cooking oil and/or grease.

8. The storage tank of claim 7, further comprising a full tank determining means which determines when the tank is full of cooking oil or grease.

9. A storage tank as set forth in claim 7, further comprising a power and control box secured to the top lid member, the power and control box including a thermostat for controlling the elongated heating element to limit the temperature of the cooking oil and/or grease located within the storage tank.

10. A storage tank as set forth in claim 9, in which said elongated heating element heats the grease to a temperature of about 110 degree–120 degree F.

11. A storage tank as set forth in claim 7, in which, said elongated heating element is secured to the drain pipe at a lower portion thereof.

* * * * *